US012535065B2

(12) United States Patent
Abo

(10) Patent No.: US 12,535,065 B2
(45) Date of Patent: Jan. 27, 2026

(54) TUBE PUMP SYSTEM AND CONTROL METHOD OF THE SAME

(71) Applicant: Surpass Industry Co., Ltd., Saitama (JP)

(72) Inventor: Kazuo Abo, Saitama (JP)

(73) Assignee: SURPASS INDUSTRY CO., LTD., Saitama (JP)

( * ) Notice: Subject to any disclaimer, the term of this patent is extended or adjusted under 35 U.S.C. 154(b) by 0 days.

(21) Appl. No.: 18/768,388

(22) Filed: Jul. 10, 2024

(65) Prior Publication Data

US 2025/0020119 A1 Jan. 16, 2025

(30) Foreign Application Priority Data

Jul. 14, 2023 (JP) ..... 2023-116259

(51) Int. Cl.
*F04B 49/22* (2006.01)
*F04B 11/00* (2006.01)
*F04B 43/12* (2006.01)

(52) U.S. Cl.
CPC ..... *F04B 49/22* (2013.01); *F04B 11/00* (2013.01); *F04B 43/1253* (2013.01)

(58) Field of Classification Search
CPC ..... F04B 49/22; F04B 11/00; F04B 43/1253; F04C 15/06; F04C 15/0057; F04C 2240/60; F16M 13/02
See application file for complete search history.

(56) References Cited

U.S. PATENT DOCUMENTS

| | | | | |
|---|---|---|---|---|
| 5,062,775 | A | 11/1991 | Orth | |
| 2015/0159642 | A1 | 6/2015 | Sasa et al. | |
| 2018/0074525 | A1 | 3/2018 | Imai et al. | |
| 2020/0263682 | A1* | 8/2020 | Imai | F04B 43/1253 |
| 2021/0206521 | A1* | 7/2021 | Cichy | F04B 49/065 |

FOREIGN PATENT DOCUMENTS

| | | | |
|---|---|---|---|
| EP | 3696412 | A1 | 8/2020 |
| JP | 2018044488 | A | 3/2018 |

OTHER PUBLICATIONS

Extended European Search Report issued on Nov. 5, 2024, in EP Application No. 24187349.6.

* cited by examiner

*Primary Examiner* — Shafiq Mian
(74) *Attorney, Agent, or Firm* — Panitch Schwarze Belisario & Nadel LLP

(57) ABSTRACT

Provided is a tube pump system including: a tube pump; a pipe including a flow channel causing a liquid delivered from a tube to flow formed therein; an orifice arranged at a first predetermined position; a selector valve arranged at a second predetermined position; and a control unit. The control unit controls the tube pump and the selector valve to synchronize a delivering timing to switch the tube pump from the stop state to the delivering state and a flowing timing to switch the selector valve from the blocking state to the flowing state and synchronize a stop timing to switch the tube pump from the delivering state to the stop state and a blocking timing to switch the selector valve from the flowing state to the blocking state.

7 Claims, 9 Drawing Sheets

TUBE PUMP SYSTEM AND CONTROL METHOD OF THE SAME

CROSS-REFERENCE TO RELATED APPLICATIONS

This application claims foreign priority benefits under U.S.C. § 119 to Japanese Patent Application No. 2023-116259 filed on Jul. 14, 2023, the contents of which is hereby incorporated by reference in its entirety.

BACKGROUND

1. Technical Field

The present disclosure relates to a tube pump system and a method for controlling the tube pump system.

2. Description of Related Art

Conventionally, a tube pump has been known where a tube having flexibility is intermittently compressed by a plurality of rollers so as to supply a liquid in the tube under pressure. The tube pump intermittently supplies the liquid under pressure and hence, pulsation (an operation where an increase and a decrease in flow rate is repeated) is generated in the liquid supplied under pressure.

Japanese Unexamined Patent Application, Publication No. 2018-44488 (patent document 1) discloses the following problem. When a tube compressed by a roller returns to the original shape, pulsation is generated due to a phenomenon that a liquid is drawn back toward the tube pump side from a path on the downstream side. Patent document 1 discloses a technique where, to suppress such pulsation, when one of a pair of roller units passes through a separation position, at which the roller unit separates from the tube, the pressure of a liquid in the tube closed due to contact with the pair of roller units is caused to rise. According to patent document 1, the pressure of a liquid in the tube is caused to rise and hence, it is possible to suppress the phenomenon that a liquid is drawn back toward the tube pump side.

In life science fields such as medical care or physical and chemical science, there may be a demand for intermittent ejection (dispense) of a fixed amount of a liquid used as an analyte or a sample. In a tube pump system disclosed in patent document 1, a pair of drive units configured to drive a pair of roller parts are controlled so that a flow rate corresponding to a liquid value measured by a flow meter is a predefined target flow rate. The tube pump system disclosed in patent document 1 is advantageous in that it is possible to suppress pulsation of an ejected liquid but is not optimized for use of intermittent ejection of a fixed amount of a liquid.

BRIEF SUMMARY

The present disclosure has been made in view of such circumstances and intends to provide a tube pump system and a control method of the same that enable a liquid delivered from a tube pump to a pipe to be intermittently ejected by a fixed amount from the pipe.

To achieve the above object, the tube pump system and the control method of the same of the present disclosure employ the following solutions.

The tube pump system according to one aspect of the present disclosure includes: a tube pump configured to deliver a liquid in a tube formed of a flexible material by intermittently pinching the tube and perform switching between a delivering state for delivering a liquid and a stop state for not delivering a liquid; a pipe connected to the tube at one end of the pipe and including a flow channel formed inside the pipe, the flow channel causing a liquid delivered from the tube to flow in a flow direction from the one end to the other end; a reduced diameter part arranged at a first predetermined position between the one end and the other end of the pipe and providing the smallest sectional area of a channel cross section orthogonal to the flow direction in the flow channel; a selector valve arranged at a second predetermined position between the one end and the other end of the pipe and configured to perform switching between a flowing state where a liquid passes through the second predetermined position and a blocking state where a liquid flow is blocked at the second predetermined position; and a control unit configured to control the tube pump and the selector valve so that a liquid is intermittently ejected from the other end of the pipe. The control unit controls the tube pump and the selector valve to synchronize a delivering timing and a flowing timing and synchronize a stop timing and a blocking timing, the delivering timing being a timing to switch the state of the tube pump from the stop state to the delivering state, the flowing timing being a timing to switch the state of the selector valve from the blocking state to the flowing state, the stop timing being a timing to switch the state of the tube pump from the delivering state to the stop state, and the blocking timing being a timing to switch the state of the selector valve from the flowing state to the blocking state.

According to the tube pump system of one aspect of the present disclosure, the tube pump intermittently pinches the tube formed of a flexible material, and thereby a liquid in the tube is delivered and guided to the flow channel formed inside the pipe whose one end is connected to the tube. The reduced diameter part providing the smallest sectional area of the channel cross section in the flow channel is arranged at the first predetermined position in the pipe. Since the liquid flow resistance at the reduced diameter part is largest in the flow channel, a liquid flowing through the flow channel from one end of the pipe to the reduced diameter part is in a state where the dynamic pressure is lower and the static pressure is higher compared to a case where the reduced diameter part is not provided in the flow channel.

According to the tube pump system of one aspect of the present disclosure, the tube pump and the selector valve are controlled so that the delivering timing at the tube pump and the flowing timing at the selector valve are synchronized and the stop timing at the tube pump and the blocking timing at the selector valve are synchronized. Since the stop timing at the tube pump and the blocking timing at the selector valve are synchronized, liquid ejection from the other end of the pipe is stopped in a state where the static pressure of the liquid is maintained constant between the one end of the pipe and the second predetermined position at which the selector valve is arranged.

Further, since the delivering timing at the tube pump and the flowing timing at the selector valve are synchronized, liquid ejection from the other end of the pipe is started in a state where the static pressure of the liquid is maintained constant between the one end of the pipe and the second predetermined position at which the selector valve is arranged. Since the start and the stop of the liquid ejection from the other end of the pipe are switched in a state where the static pressure of the liquid is maintained constant between the one end of the pipe and the second predetermined position at which the selector valve is arranged, the liquid delivered from the tube pump to the pipe can be intermittently ejected by a fixed amount from the other end of the pipe.

The tube pump system according to one aspect of the present disclosure may be configured such that the tube pump has an accommodation part having an inner circumferential face arc-shaped about an axis, the tube being arranged on the inner circumferential face, a pair of roller parts accommodated in the accommodation part and configured to be rotated about the axis with the tube being closed from a closure position to a release position about the axis, and a pair of drive units configured to rotate each of the pair of roller parts in the same direction about the axis, the tube pump system further includes a pressure detecting unit to determine a pressure of a liquid delivered from the tube to the pipe, and the control unit controls each of the pair of drive units so that a variation range of the pressure of the liquid determined by the pressure detecting unit is within predetermined values when the pair of roller parts are rotated by at least one turn.

According to the tube pump system of the present configuration, the pair of roller parts are rotated in the same direction about the axis by the pair of drive units, respectively, and thereby the pair of roller parts are rotated from the closure position to the release position while pinching the tube. The control unit controls each of the pair of drive units to allow a liquid flowing in from the one end of the tube to be ejected from the other end of the tube. The variation range of a liquid pressure determined by the pressure detecting unit in at least one turn of rotation of the pair of roller parts represents how large the pulsation of the liquid pumped by the tube pump system is. When the tube that has been pinched by the roller parts by one of the pair of roller parts passing through the release position returns to the original shape, a larger pressure difference between the pressure of the liquid downstream of the release position and the pressure of the liquid upstream of the release position results in a larger variation range of the pressure. In the tube pump system of the present configuration, the control unit controls each of the pair of drive units so that the pressure variation range determined by the pressure detecting unit is within predetermined values. Thus, even when the state of pulsation dynamically changes, the pulsation can be suitably suppressed in accordance with the change.

The tube pump system of the above configuration may be formed such that the control unit controls a first rotation angle and a second rotation angle so that the variation range of the pressure determined by the pressure detecting unit is within the predetermined value, the first rotation angle being an angle about the axis between the pair of roller parts when a first one of the roller parts passes through the closure position, and the second rotation angle being an angle about the axis between the pair of roller parts when a second one of the roller parts passes through the release position.

According to the tube pump system of the present form, the pressure difference between the downstream liquid and the upstream liquid of the release position is in accordance with the first rotation angle and the second rotation angle. That is, a larger difference between the first rotation angle and the second rotation angle results in a higher pressure of the liquid in the tube closed due to the contact with the pair of roller parts, and a smaller difference between the first rotation angle and the second rotation angle results in a lower pressure of the liquid in the tube closed due to the contact with the pair of roller parts.

Accordingly, in the tube pump system of the present form, the control unit controls the first rotation angle about the axis between the pair of roller parts when the first roller part passes through the closure position and controls the second rotation angle about the axis between the pair of roller parts when the second roller part passes through the release position so that the variation range of the pressure determined by the pressure detecting unit is within predetermined values. According to the tube pump system of the present form, even when the state of pulsation dynamically changes, the pulsation can be suitable suppressed in accordance with the change.

The tube pump system according to one aspect of the present disclosure may be configured such that the first predetermined position at which the reduced diameter part is arranged is present between the one end of the pipe and the second predetermined position at which the selector valve is arranged, and the volume of the flow channel from the first predetermined position to the second predetermined position in the pipe is 1/10 or less of the volume from the one end of the pipe to the second predetermined position.

According to the tube pump system of the present configuration, the volume of the flow channel from the first predetermined position to the second predetermined position in the pipe is 1/10 or less of the volume from the one end of the pipe to the second predetermined position. Thus, when the tube pump is in the stop state and the selector valve is in the blocking state, it is possible to suppress the flow rate of a liquid flowing out from the first predetermined position at which the reduced diameter part is arranged to the second position at which the selector valve is arranged. It is thus possible to suitably suppress that the pressure of a liquid in the flow channel from the one end of the pipe to the reduced diameter part is reduced and the flow rate of the liquid intermittently ejected from the pipe is reduced accordingly.

The tube pump system according to one aspect of the present disclosure may be configured such that the control unit controls the tube pump and the selector valve so that a timing after a first predetermined period elapsed from the delivering timing is the flowing timing and that a timing after a second predetermined period elapsed from the stop timing is the blocking timing.

According to the tube pump system of the present configuration, by delaying the flowing timing by the first predetermined period from the delivering timing, it is possible to switch the state of the tube pump from the stop state to the delivering state to increase the pressure of a liquid held in the pipe and then switch the state of the selector valve from the blocking state to the flowing state to increase the ejecting amount of the liquid.

Further, by delaying the blocking timing by the second predetermined period from the stop timing, it is possible to switch the state of the selector valve from the flowing state to the blocking state to reduce the pressure of a liquid in the pipe in the blocking state without switching the state of the tube pump from the delivering state to the stop state to increase the pressure of the liquid held in the pipe. Further, by suitably adjusting the first predetermined period and the second predetermined period, it is possible to adjust the ejecting amount of the intermittently ejected liquid to a suitable amount.

The tube pump system according to one aspect of the present disclosure may be configured such that the control unit controls the tube pump and the selector valve so that a timing after a third predetermined period elapsed from the flowing timing is the delivering timing and that a timing after a fourth predetermined period elapsed from the blocking timing is the stop timing.

According to the tube pump system of the present configuration, by delaying the delivering timing by the third predetermined period from the flowing timing, it is possible to switch the state of the selector valve from the blocking state to the flowing state to reduce the pressure of a liquid held in the pipe and then switch the state of the tube pump from the stop state to the delivering state to reduce the ejecting amount of the liquid.

Further, by delaying the stop timing by the fourth predetermined period from the blocking timing, it is possible to switch the state of the selector valve from the flowing state to the blocking state to increase the pressure of a liquid held in the pipe and then switch the state of the tube pump from the delivering state to the stop state to increase the pressure of the liquid in the pipe in the blocking state. Further, by suitably adjusting the third predetermined period and the fourth predetermined period, it is possible to adjust the ejecting amount of the intermittently ejected liquid to a suitable amount.

In a control method of a tube pump system according to one aspect of the present disclosure, the tube pump system includes a tube pump configured to deliver a liquid in a tube formed of a flexible material by intermittently pinching the tube and perform switching between a delivering state for ejecting a liquid and a stop state for not delivering a liquid, a pipe connected to the tube at one end of the pipe and including a flow channel formed inside the pipe, the flow channel causing a liquid delivered from the tube to flow in a flow direction from the one end to the other end, a reduced diameter part arranged at a first predetermined position between the one end and the other end of the pipe and providing the smallest sectional area of a channel cross section orthogonal to the flow direction in the flow channel, and a selector valve arranged at a second predetermined position between the one end and the other end of the pipe and configured to perform switching between a flowing state where a liquid passes through the second predetermined position and a blocking state where a liquid flow is blocked at the second predetermined position. The control method includes: a first control step of controlling the tube pump and the selector valve to synchronize a delivering timing and a flowing timing, the delivering timing being a timing to switch the state of the tube pump from the stop state to the delivering state, and the flowing timing being a timing to switch the state of the selector valve from the blocking state to the flowing state; and a second control step of controlling the tube pump and the selector valve to synchronize a stop timing and a blocking timing, the stop timing being a timing to switch the state of the tube pump from the delivering state to the stop state, and the blocking timing being a timing to switch the state of the selector valve from the flowing state to the blocking state.

According to a control method of the tube pump system of one aspect of the present disclosure, the tube pump intermittently pinches the tube formed of a flexible material, and thereby a liquid in the tube is delivered and guided to the flow channel formed inside the pipe whose one end is connected to the tube. The reduced diameter part providing the smallest sectional area of the channel cross section in the flow channel is arranged at the first predetermined position in the pipe. Since the liquid flow resistance at the reduced diameter part is largest in the flow channel, a liquid flowing through the flow channel from one end of the pipe to the reduced diameter part is in a state where the dynamic pressure is lower and the static pressure is higher compared to a case where the reduced diameter part is not provided in the flow channel.

According to a control method of the tube pump system of one aspect of the present disclosure, the tube pump and the selector valve are controlled so that the delivering timing at the tube pump and the flowing timing at the selector valve are synchronized and the stop timing at the tube pump and the blocking timing at the selector valve are synchronized. Since the stop timing at the tube pump and the blocking timing at the selector valve are synchronized, liquid ejection from the other end of the pipe is stopped in a state where the static pressure of the liquid is maintained constant between the one end of the pipe and the second predetermined position at which the selector valve is arranged.

Further, since the delivering timing at the tube pump and the flowing timing at the selector valve are synchronized, liquid ejection from the other end of the pipe is started in a state where the static pressure of the liquid is maintained constant between the one end of the pipe and the second predetermined position at which the selector valve is arranged. Since the start and the stop of the liquid ejection from the other end of the pipe are switched in a state where the static pressure of the liquid is maintained constant between the one end of the pipe and the second predetermined position at which the selector valve is arranged, the liquid delivered from the tube pump to the pipe can be intermittently ejected by a fixed amount from the pipe.

According to the present disclosure, a tube pump system and a control method of the same are provided that enable a liquid delivered from a tube pump to a pipe to be intermittently ejected by a fixed amount from the pipe.

DETAILED DESCRIPTION

First Embodiment

A tube pump system according to a first embodiment of the present disclosure and one embodiment of a control method thereof will be described below with reference to the drawings. A tube pump system 700 of the present embodiment is a device that pumps a liquid from an inflow end 701 to an outflow end 702 and intermittently ejects a fixed amount of a liquid from the outflow end 702. For example, the liquid pumped from the tube pump system 700 of the present embodiment is a liquid used as an analyte or a sample.

Figure 1:
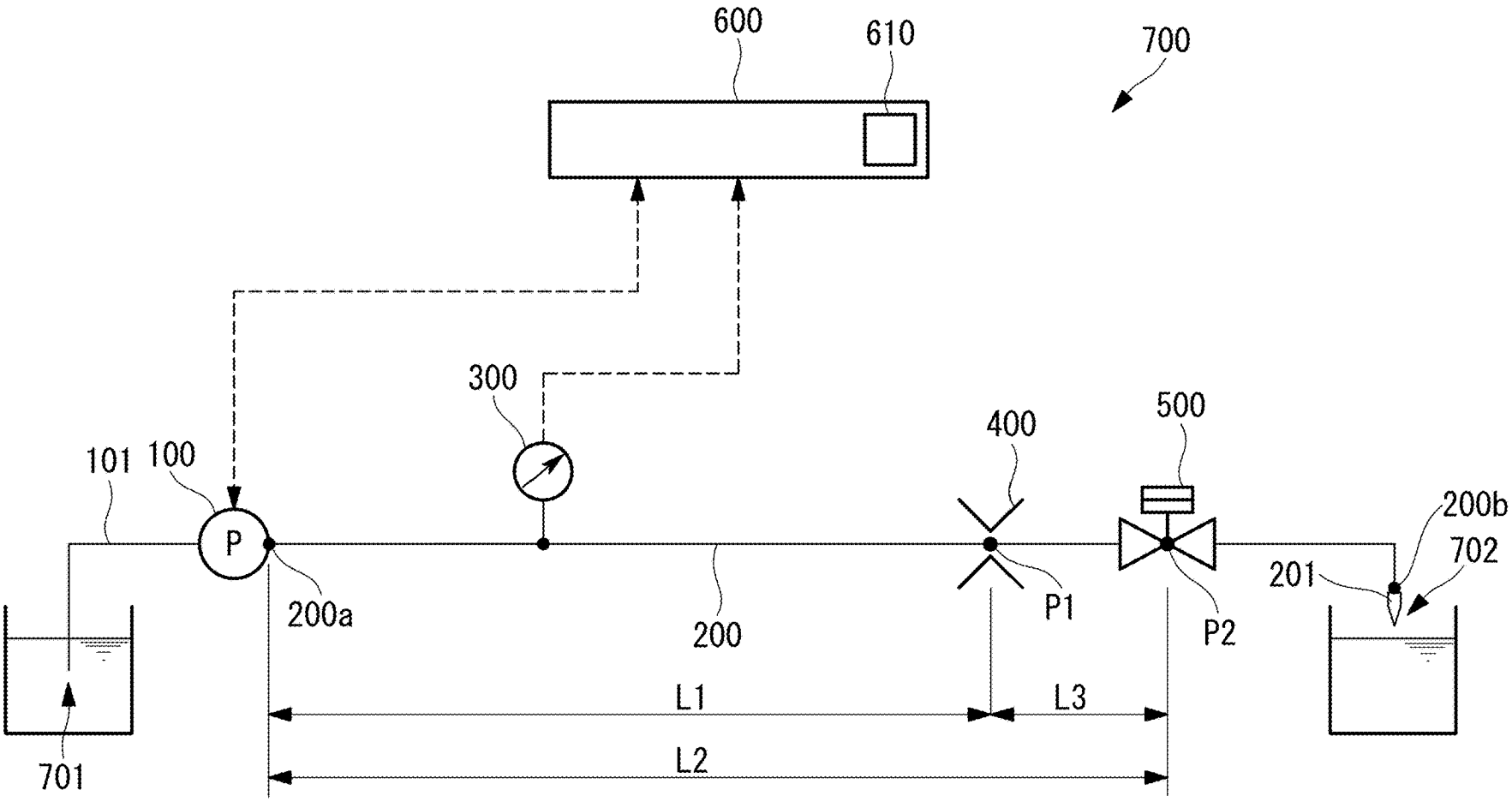
FIG. 1 is a configuration diagram illustrating a tube pump system according to a first embodiment of the present disclosure.

As illustrated in FIG. 1, a tube pump system 700 of the present embodiment includes a tube pump 100, a pipe 200, a pressure sensor (pressure detecting unit) 300, an orifice (reduced diameter part) 400, a selector valve 500, and a control unit 600. Respective features of the tube pump system 700 of the present embodiment will be described below.

The tube pump 100 is a device that pumps a liquid from the inflow end 701 to the outflow end 702. The tube pump 100 pumps a liquid by repeating an operation of moving rollers while pinching a flexible tube 101 by the rollers. The liquid ejected from the tube pump 100 to the pipe 200 passes through the orifice 400 and the selector valve 500 and reaches the outflow end 702. The state of the tube pump 100 is switched by the control unit 600 between a delivering state for delivering a liquid and a stop state for not delivering a liquid. The detail of the tube pump 100 will be described later.

The pipe 200 is a pipe member whose one end 200*a* is connected to the tube 101 of the tube pump 100 and in which a flow channel for causing a liquid delivered from the tube 101 to flow in a flow direction from the one end 200*a* to the other end 200*b* is formed. A nozzle 201 is attached to the other end 200*b* of the pipe 200. The pipe 200 is formed of a flexible material (for example, a resin material such as silicone). The pipe 200 can maintain the pressure of a liquid flowing through the flow channel to be higher than the atmospheric pressure when the channel sectional area of the orifice 400 is suitably set.

As illustrated in FIG. 1, a first predetermined position P1 at which the orifice 400 is arranged is present between the one end 200*a* of the pipe 200 and a second predetermined position P2 at which the selector valve 500 is arranged. The volume of the flow channel from the first predetermined position P1 to the second predetermined position P2 in the pipe 200 is preferably 1/10 or less of the volume from the one end 200*a* of the pipe 200 to the second predetermined position P2.

When the channel sectional area of the pipe 200 is the same in the entire section except for the orifice 400, the length L3 of the flow channel from the first predetermined position P1 to the second predetermined position P2 in the pipe 200 is preferably 1/10 or less of the length L2 from the one end 200*a* of the pipe 200 to the second predetermined position P2. The length L2 is a length of the sum of the length L1 from the one end 200*a* of the pipe 200 to the first predetermined position P1 and the length L3.

The pressure sensor 300 is a device that determines the pressure of a liquid delivered from the tube 101 of the tube pump 100 to the pipe 200. The pressure sensor 300 is arranged upstream in the flow direction from the orifice 400 in the pipe 200 that guides a liquid from the tube pump 100 to the selector valve 500. The pressure sensor 300 transfers a determined pressure to the control unit 600.

The orifice 400 is a member arranged at the first predetermined position P1 in the flow channel between the one end 200*a* and the other end 200*b* of the pipe 200 and providing the smallest sectional area of the channel cross section orthogonal to the flow direction in the flow channel. The orifice 400 is a member for maximizing a liquid flow resistance in the flow channel to increase the static pressure of a liquid in the upstream portion from the orifice 400 in the flow direction of the pipe 200.

Herein, it is desirable to set the sectional area of the channel cross section of the orifice 400 such that the static pressure of a liquid in the upstream portion from the orifice 400 in the flow direction of the pipe 200 ranges from 20 kPaG to 250 kPaG. It is desirable to set the sectional area of the channel cross section of the orifice 400 to range, in particular, from 90 kPaG to 110 kPaG. Herein, "G" means a gage pressure. The sectional area of the channel cross section defined by the orifice 400 is set to a range of 5% or larger and 70% or smaller, for example, relative to the sectional area of the channel cross section of the remaining portion of the pipe 200.

The selector valve 500 is a valve body arranged at the second predetermined position P2 between the one end 200*a* and the other end 200*b* of the pipe 200. The selector valve 500 switches the state between a flowing state where a liquid passes through the second predetermined position P2 and a blocking state where a liquid flow is blocked at the second predetermined position P2. For example, the selector valve 500 is a pinch valve that pinches the outer circumference face of the flexible pipe 200 to close the fluid channel.

The control unit 600 is a device that controls the tube pump 100 and the selector valve 500 so that a fixed amount of a liquid is intermittently ejected from the other end 200*b* of the pipe 200. The control unit 600 controls each of a first drive unit 50 and a second drive unit 60 described later so as to cause a liquid flowing in from one end of the flexible tube 101 of the tube pump 100 to be ejected from the other end of the tube 101.

As described later, the control unit 600 controls the tube pump 100 and the selector valve 500 to synchronize a delivering timing to switch the state of the tube pump 100 from the stop state to the delivering state and a flowing timing to switch the state of the selector valve 500 from the blocking state to the flowing state. Further, the control unit 600 controls the tube pump 100 and the selector valve 500 to synchronize a delivering timing to switch the state of the tube pump 100 from the delivering state to the stop state and a blocking timing to switch the state of the selector valve 500 from the flowing state to the blocking state.

As shown in FIG. 1, the control unit 600 includes a memory unit 610. The memory unit 610 stores a program performed by the control unit 600. The control unit 600 reads and performs the program stored in the memory unit 610, thus performing respective processes mentioned later. The memory unit 610 is formed of a nonvolatile memory capable of rewriting data, for example. As will be mentioned later, the control unit 600 adjusts a control waveform for controlling the first drive unit 50 and the second drive unit 60, and stores the adjusted control waveform in the memory unit 610. The control unit 600 reads the control waveform stored in the memory unit 610 so that the control unit 600 can control the first drive unit 50 and the second drive unit 60 using the adjusted control waveform.

Figure 2:
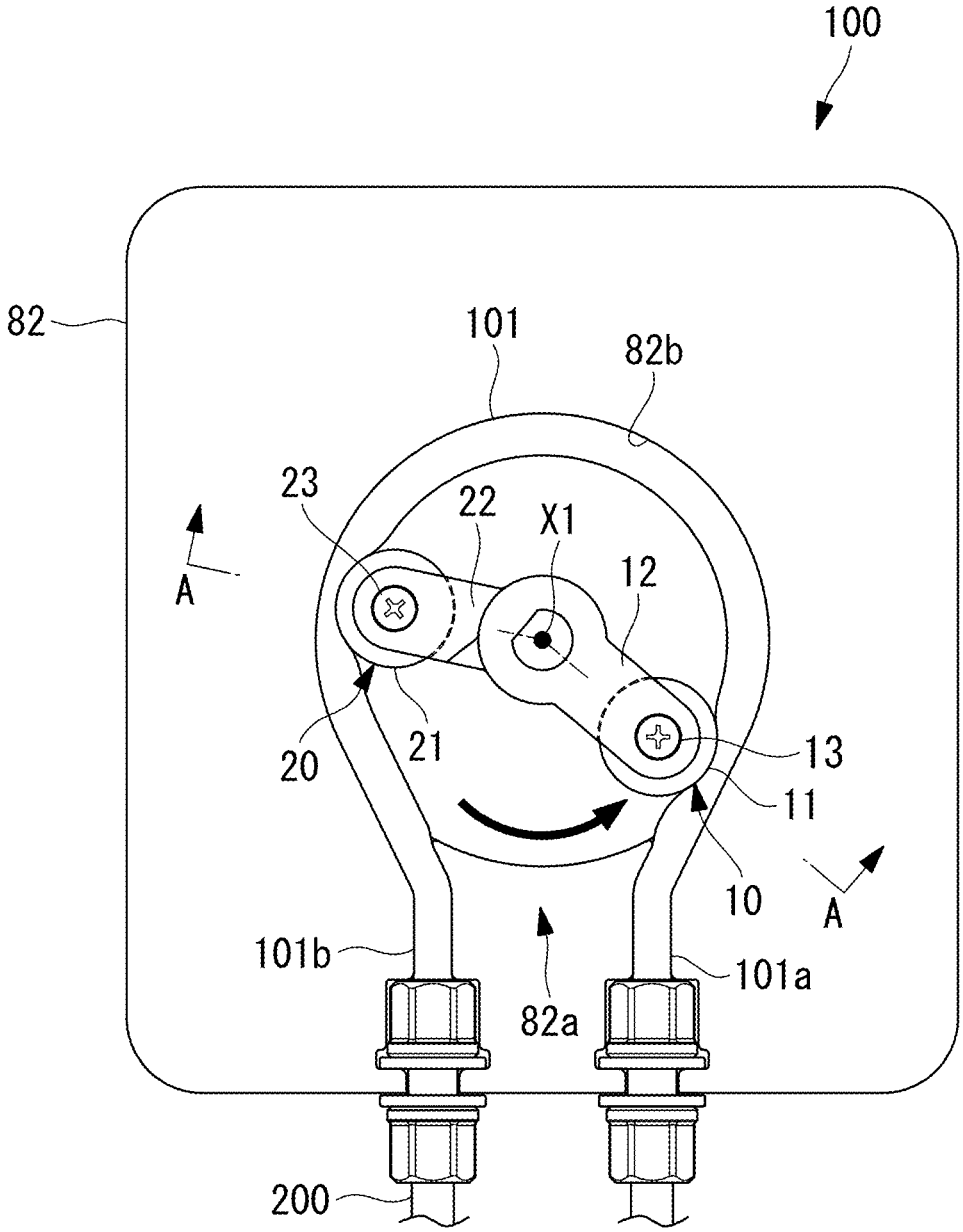
FIG. 2 is a front view of a tube pump illustrated in FIG. 1.
Figure 3:
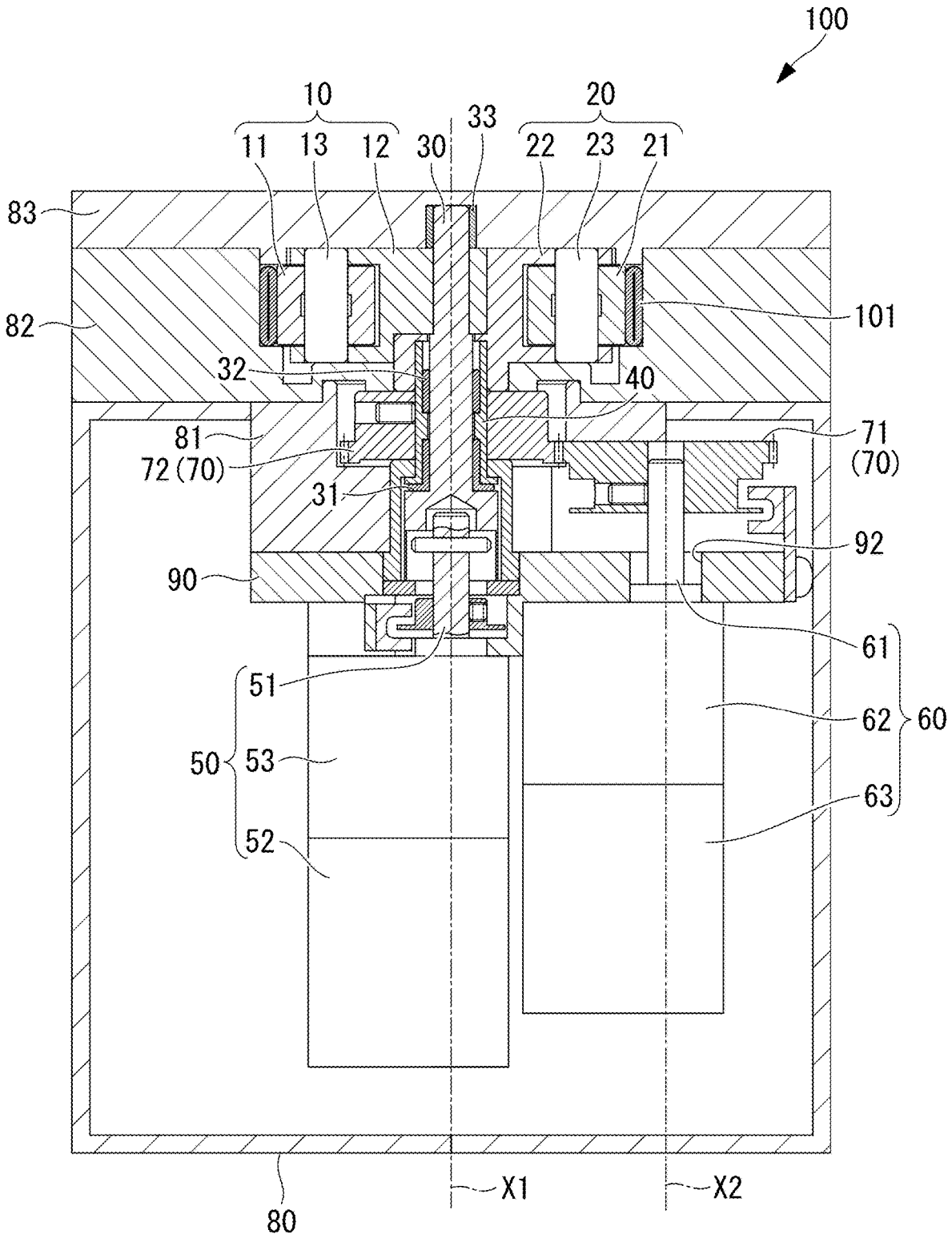
FIG. 3 is a sectional view taken along the arrow A-A of the tube pump illustrated in FIG. 2.

Next, the tube pump 100 of the tube pump system 700 will be explained. FIG. 2 is a front view of a tube pump illustrated in FIG. 1. FIG. 3 is a sectional view taken along the arrow A-A of the tube pump illustrated in FIG. 2.

The tube pump 100 of this embodiment shown in FIG. 2 is a device where a first roller unit 10 (first contact member) and a second roller unit 20 (second contact member) are rotated around an axis line X1 (first axis line) in the same direction so as to make a fluid in a tube 101 which flows into the tube 101 discharge from an inflow-side end portion 101*a* to an outflow-side end portion 101*b*. The pipe 200 is connected to the outflow-side end portion 101*b*. FIG. 2 shows the tube pump 100 in a state where a cover 83 shown in FIG. 3 is removed.

In the tube pump 100, the tube 101 is arranged in a circular-arc shape around the axis line X1 along an inner peripheral surface 82*b* of a recess 82*a* of a roller housing unit 82 that houses the first roller unit 10 and the second roller unit 20. As shown in FIG. 2, the first roller unit 10 and the second roller unit 20 housed in the roller housing unit 82 are rotated around the axis line X1 along a counter-clockwise rotation direction (a direction shown by an arrow in FIG. 2) while being in contact with the tube 101.

As shown in FIG. 3, the tube pump 100 of the embodiment includes: the first roller unit 10 and the second roller unit 20 that rotate around the axis X1 while being in contact with the tube 101; a drive shaft 30 (a shaft member) that is arranged on the axis X1 and is coupled to the first roller unit 10; a drive cylinder (a cylindrical member) 40 that is coupled to the second roller unit 20; a first drive unit 50 that transmits a drive force to the drive shaft 30; a second drive unit 60; and a transmission mechanism 70 (a transmission unit) that transmits a drive force of the second drive unit 60 to the drive cylinder 40.

The first roller unit 10 has: a first roller 11 that rotates around an axis parallel to the axis X1 while being in contact with the tube 101; a first roller support member 12 coupled to the drive shaft 30 so as to integrally rotate around the axis X1; and a first roller shaft 13 both ends of which are supported by the first roller support member 12, and to which the first roller 11 is rotatably attached.

The second roller unit 20 has: a second roller 21 that rotates around an axis parallel to the axis X1 while being in contact with the tube 101; a second roller support member 22 coupled to the drive cylinder 40 so as to integrally rotate around the axis X1; and a second roller shaft 23 both ends of which are supported by the second roller support member 22, and to which the second roller 21 is rotatably attached.

The lower end of the drive shaft 30 is coupled to the first drive shaft 51, and an upper end thereof is inserted into an insertion hole formed in the cover 83. A third bearing member 33 that rotatably supports a tip of the first drive shaft 51 around the axis X1 is inserted into the insertion hole of the cover 83. In addition, the drive shaft 30 is rotatably supported around the axis X1 on an inner peripheral side of the drive cylinder 40 by a cylindrical first bearing member 31 inserted along the outer peripheral surface, and a cylindrical second bearing member 32 formed independently from the first bearing member 31.

As shown in FIG. 3, the first drive unit 50 and the second drive unit 60 are housed inside a casing (a housing member) 80. A gear housing unit 81 for housing the transmission mechanism 70, and a support member 90 that supports the first drive unit 50 and the second drive unit 60 are attached to an inside of the casing 80. In addition, the roller housing unit 82 for housing the first roller unit 10 and the second roller unit 20 is attached to an upper part of the casing 80.

The roller housing unit 82 has the recess 82*a* that houses the first roller unit 10 and the second roller unit 20. The recess 82*a* has the inner peripheral surface 82*b* formed into a circular-arc shape around the axis line X1. As shown in FIG. 3, the tube 101 is arranged in a circular-arc shape around the axis line X1 along the inner peripheral surface 82*b*.

A first through hole that extends along the axis X1 and a second through hole 92 that extends along an axis X2 are formed in the support member 90. The first drive unit 50 is attached to the support member 90 by a fastening bolt (illustration is omitted) in a state where a first drive shaft 51 is inserted into the first through hole 91 formed in the support member 90. Similarly, the second drive unit 60 is attached to the support member 90 by a fastening bolt (illustration is omitted) in a state where a second drive shaft 61 is inserted into the second through hole 92 formed in the support member 90. As described above, each of the first drive unit 50 and the second drive unit 60 is attached to the support member 90, which is the integrally formed member.

The first drive unit 50 has; the first drive shaft 51; the first electric motor 52; and a first reducer 53 that reduces a velocity of rotation of a rotation shaft (illustration is omitted) rotated by the first electric motor 52, and transmits the rotation to the first drive shaft 51. The first drive unit 50 rotates the first drive shaft 51 around the axis X1 by transmitting a drive force of the first electric motor 52 to the first drive shaft 51.

The first roller support member 12 of the first roller unit 10 is coupled to the tip side of the drive shaft 30 so as to integrally rotate around the axis X1. The drive force by which the first drive unit 50 rotates the first drive shaft 51 around the axis X1 is transmitted from the first drive shaft 51 to the first roller unit 10 through the drive shaft 30.

The second drive unit 60 has; the second drive shaft 61 arranged on the axis X2; a second electric motor 62; and a second reducer 63 that reduces a velocity of rotation of a rotation shaft (illustration is omitted) rotated by the second electric motor 62, and transmits the rotation to the second drive shaft 61. The second drive unit 60 rotates the second drive shaft 61 around the axis X2 by transmitting a drive force of the second electric motor 62 to the second drive shaft 61.

The transmission mechanism 70 has: a first gear unit 71 that rotates around the axis X2 (a second axis) parallel to the axis X1; and a second gear unit 72 to which a drive force of the second drive shaft 61 is transmitted from the first gear unit 71. The transmission mechanism 70 transmits the drive force of the second drive shaft 61 around the axis X2 to the outer peripheral surface of the drive cylinder 40, and rotates the drive cylinder 40 around the axis X1.

The second roller support member 22 of the second roller unit 20 is coupled to a tip side of the drive cylinder 40 so as to integrally rotate around the axis X1. As described above, the drive force by which the second drive unit 60 rotates the second drive shaft 61 around the axis X2 is transmitted to the outer peripheral surface of the drive cylinder 40 by the transmission mechanism 70, and is transmitted from the drive cylinder 40 to the second roller unit 20.

Next, discharging of a liquid performed by the tube pump system 700 of this embodiment will be explained with reference to drawings. As shown in FIG. 1, the tube pump system 700 of this embodiment detects a pressure of the liquid discharged from the tube pump 100 to the pipe 200 by the pressure sensor 300, and transmits the pressure of the liquid to the control unit 600.

In the tube pump system 700 shown in FIG. 1, a control signal for controlling the first drive unit 50 and the second drive unit 60 of the tube pump 100 is transmitted from the control unit 600 to the tube pump 100. The tube pump 100 may be formed as a device in which the control unit 600 is incorporated. In this case, the control unit 600 incorporated in the tube pump 100 generates a control signal for controlling the first drive unit 50 and the second drive unit 60, and transmits the control signal to the first drive unit 50 and the second drive unit 60.

Figure 4:
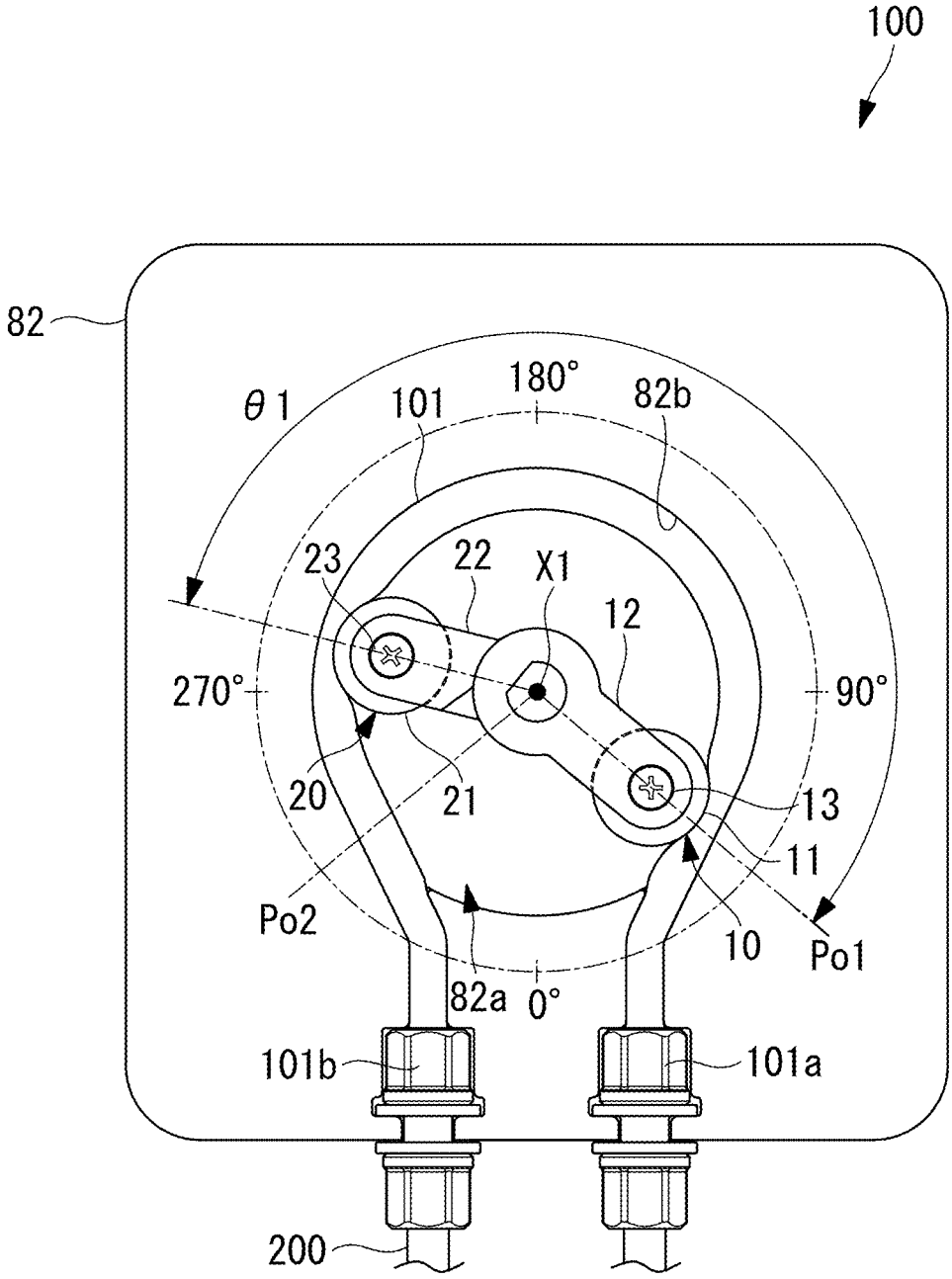
FIG. 4 is a front view illustrating the tube pump in a state where a first roller part reached a closure position.
Figure 5:
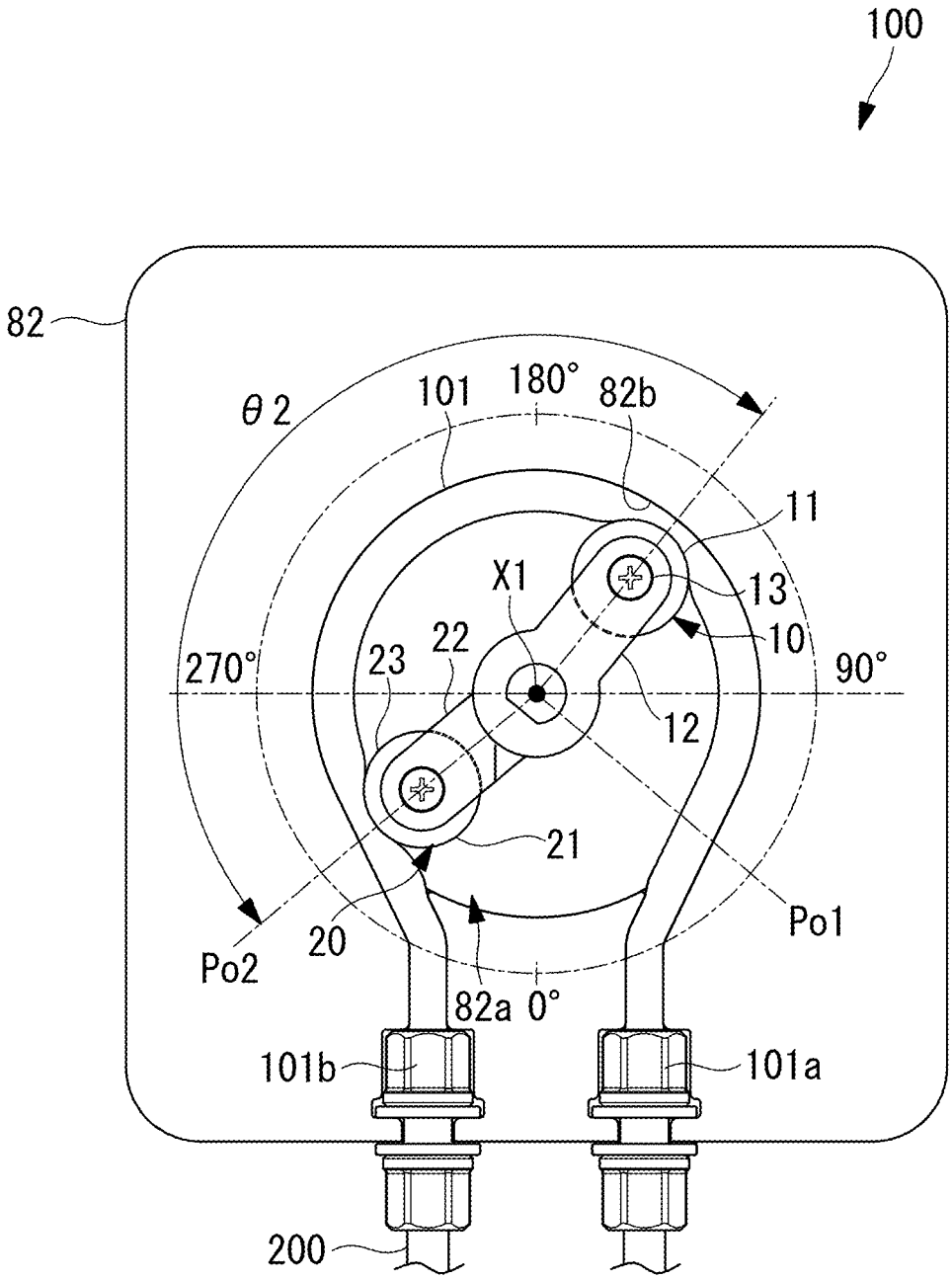
FIG. 5 is a front view illustrating the tube pump in a state where a second roller part reached a release position.

FIG. 4 is a front view showing the tube pump 100 in a state where the first roller unit 10 reaches a closing position Po1. FIG. 5 is a front view showing the tube pump 100 in a state where the second roller unit 20 reaches a releasing position Po2. The closing position Po1 indicates a position around the axis line X1 at which a state of the first roller unit 10 or the second roller unit 20 changes over from a state of not closing the tube 101 to a state of closing the tube 101. Further, the releasing position Po2 indicates a position around the axis line X1 at which a state where the first roller unit 10 or the second roller unit 20 closes the tube 101 is released so that a state of the first roller unit 10 or the second roller unit 20 changes over to a state of not closing the tube 101. Each of the first roller unit 10 and the second roller unit 20 is independently rotated around the axis line X1 in a state where the first roller unit 10 or the second roller unit 20 closes the tube 101 in cooperation with the inner peripheral surface 82*b* from the closing position Po1 to the releasing position Po2.

0°, 90°, 180° and 270° shown in FIG. 4 and FIG. 5 indicate rotation angles around the axis line X1, and indicate angles in the counterclockwise direction with the position of 0° as a reference. The closing position Po1 is at a rotation angle of 50°, for example. The releasing position Po2 is at a rotation angle of 310°, for example.

Figure 8:
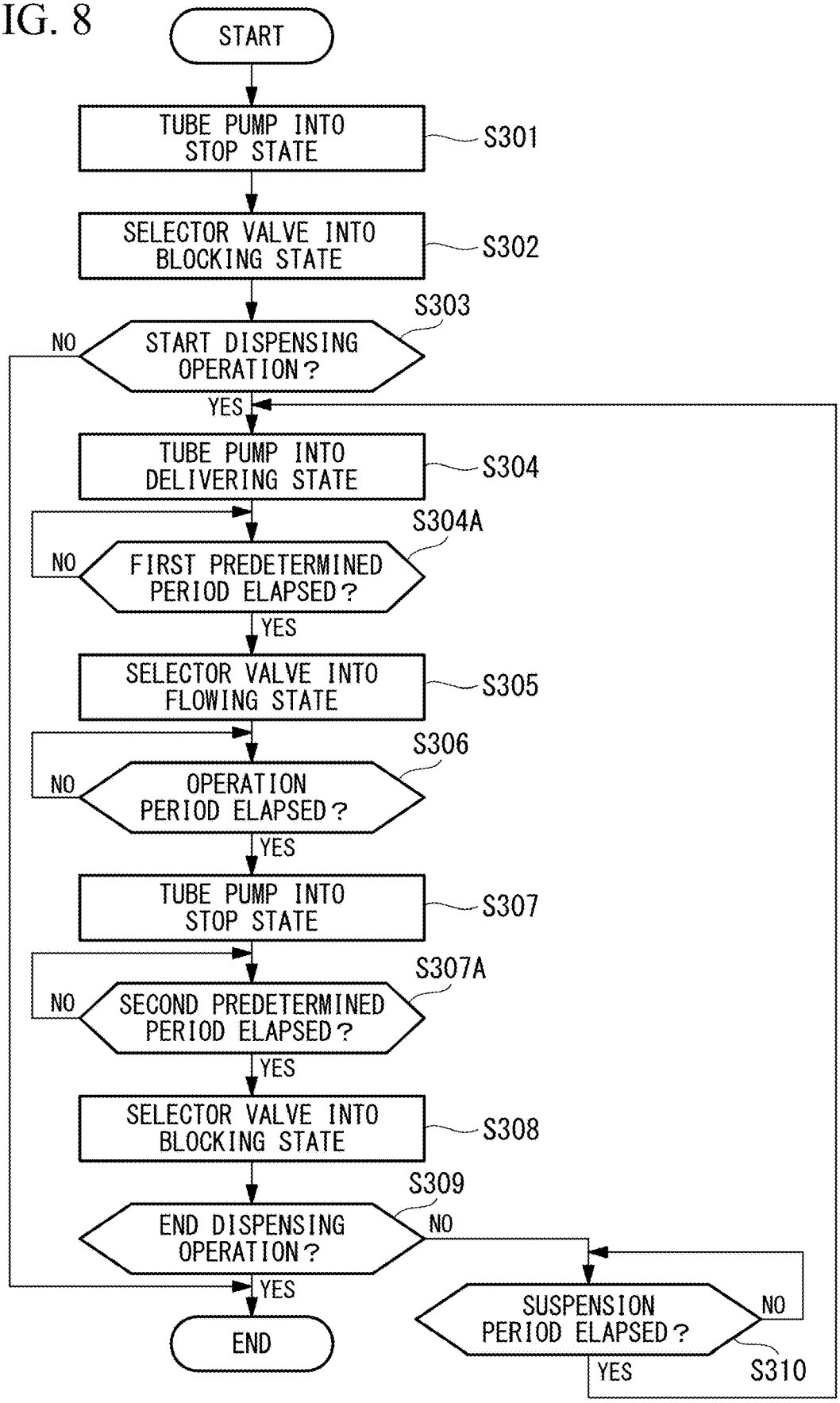
FIG. 8 is a flowchart illustrating a process performed by the control unit to cause the tube pump to intermittently deliver a liquid at a fixed flow rate in a tube pump system according to a second embodiment of the present disclosure.

The first rotation angle θ1 shown in FIG. 4 is a rotation angle around the axis line X1 formed between the first roller unit 10 and the second roller unit 20 when the first roller unit 10 passes through the closing position Po1. A second rotation angle θ2 shown in FIG. 8 is a rotation angle around the axis line X1 formed between the first roller unit 10 and the second roller unit 20 when the second roller unit 20 passes through the releasing position Po2.

Figure 6:
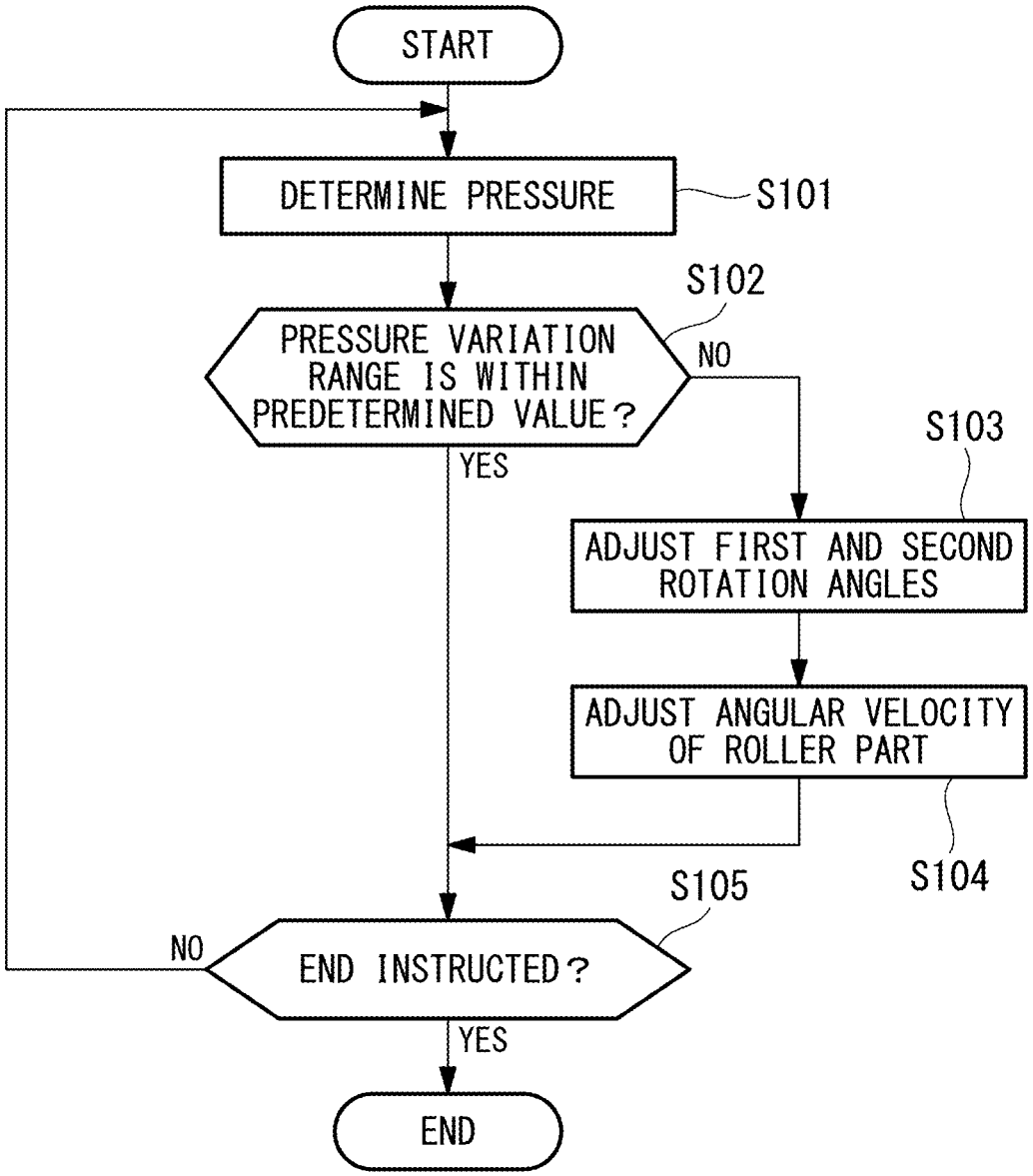
FIG. 6 is a flowchart illustrating a process performed by a control unit to cause the tube pump to continuously deliver a liquid at a fixed flow rate.

Next, a process performed by the control unit 600 will be described. FIG. 6 is a flowchart showing the process performed by the control unit 600 to cause the tube pump 100 to continuously deliver a liquid at a fixed flow rate.

When power is supplied, a target flow rate Ft [ml/min] instructed by an operator is set, the control unit 600 starts the respective processes shown in FIG. 6. The control unit 600 controls the first drive unit 50 and the second drive unit 60 such that the flow rate of a liquid delivered by the tube pump 100 agrees with the target flow rate Ft [ml/min]. The control unit 600 maintains the selector valve in an open state when the process shown in FIG. 6 is performed.

In step S101, the control unit 600 detects the pressure of a liquid which flows through the pipe 200 using the pressure sensor 300. The control unit 600 causes the memory unit 610 to store a pressure detected by the pressure sensor 300 when the first roller unit 10 and the second roller unit 20 are rotated around the axis line X1 through at least one revolution (one revolution, three revolutions, for example).

In step S102, the control unit 600 determines with reference to the pressure stored in the memory unit 610 whether or not the fluctuation ΔP of pressure when the first roller unit 10 and the second roller unit 20 are rotated around the axis line X1 through at least one revolution falls within the predetermined value Pdif. When the fluctuation ΔP does not fall within the predetermined value Pdif, the control unit 600 advances the process to step S103. On the other hand, when the fluctuation ΔP falls within the predetermined value Pdif, the control unit 600 advances the process to step S105.

In step S103, the fluctuation ΔP of pressure is larger than the predetermined value Pdif and hence, the control unit 600 adjusts the first rotation angle θ1 shown in FIG. 4 and the second rotation angle θ2 shown in FIG. 5 so as to reduce the fluctuation ΔP of pressure. The reason for the adjustment of the first rotation angle θ1 and the second rotation angle θ2 is that a pressure difference between liquid on the downstream side of the releasing position Po2 and liquid on the upstream side of the releasing position Po2 is a value which corresponds to the first rotation angle θ1 and the second rotation angle θ2. That is, the larger a difference between the first rotation angle θ1 and the second rotation angle θ2, the higher the pressure of a liquid in the tube 101 which is closed by contact with the first roller unit 10 and the second roller unit 20 becomes. The smaller a difference between the first rotation angle θ1 and the second rotation angle θ2, the lower the pressure of a liquid in the tube 101 which is closed by contact with the first roller unit 10 and the second roller unit 20 becomes.

The control unit 600 adjusts a control waveform based on which the first drive unit 50 and the second drive unit 60 are controlled such that the second rotation angle θ2 is smaller than the first rotation angle θ1. The control waveform is adjusted as described above so as to cause a liquid which flows into the tube 101 at a pressure substantially equal to the atmospheric pressure to be discharged to the pipe 200 in a state where the pressure of the liquid is set higher than the atmospheric pressure. When the second rotation angle θ2 is set smaller than the first rotation angle θ1, the pressure of a liquid discharge to the pipe 200 is set higher than the atmospheric pressure.

In step S104, the control unit 600 adjusts an angular velocity of the first roller unit 10 and the second roller unit 20 such that the flow rate per unit time of a liquid discharged to the pipe 200 from the end portion of the tube 101 is maintained at the target flow rate Ft (predetermined flow rate). The control unit 600 adjusts the angular velocities of the first roller unit 10 and the second roller unit 20 such that the larger the first rotation angle θ1, the lower an average angular velocity becomes, whereas the smaller the first rotation angle θ1, the higher an average angular velocity becomes. The reason the angular velocity of the first roller unit 10 and the second roller unit 20 is adjusted as described above is that the first rotation angle θ1 decides the amount of liquid closed in the tube 101 by the first roller unit 10 and the second roller unit 20.

The larger the first rotation angle θ1, the larger the amount of liquid which is closed in the tube 101 becomes. Whereas the smaller the first rotation angle θ1, the smaller the amount of liquid which is closed in the tube 101 becomes. The control unit 600 controls the angular velocity of the first roller unit 10 and the second roller unit 20 corresponding to the amount of liquid closed in the tube 101, thus maintaining the target flow rate Ft (predetermined flow rate).

In step S105, the control unit 600 determines whether or not an instruction for change of the target flow rate Ft or end of control is provided by the operator and, if the determination is YES, the present flowchart ends the process. If the determination is NO, the control unit 600 repeats the process subsequent to step S101.

Figure 7:
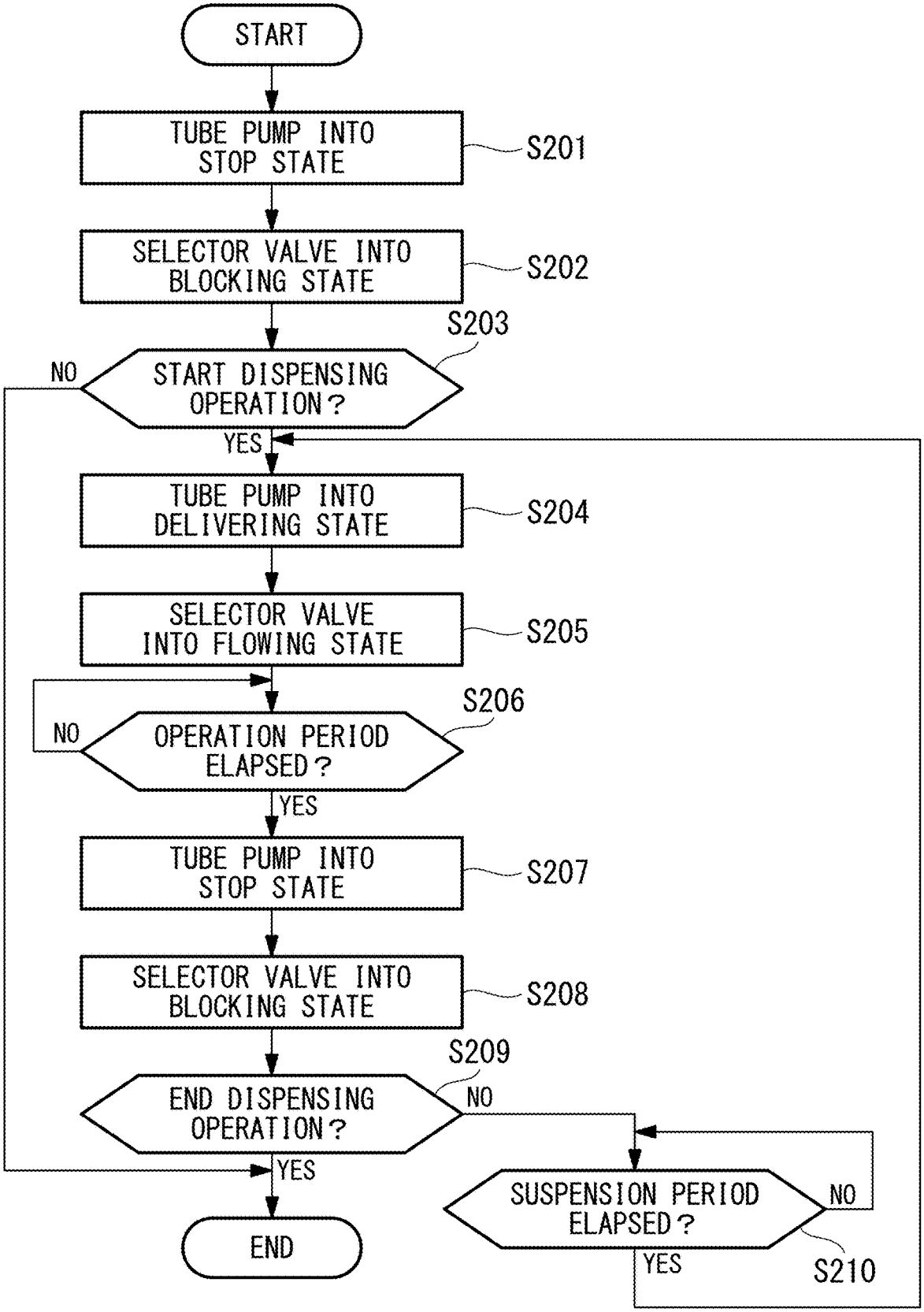
FIG. 7 is a flowchart illustrating a process performed by the control unit to cause the tube pump to intermittently deliver a liquid at a fixed flow rate.

The process illustrated in FIG. 6 described above is a process performed by the control unit 600 to cause the tube pump 100 to continuously deliver a liquid at a fixed flow rate. In contrast, the process illustrated in FIG. 7 is a process performed by the control unit 600 to cause the tube pump 100 to intermittently deliver a liquid at a fixed flow rate. FIG. 7 is a flowchart illustrating a process performed by the control unit 600 to cause the tube pump 100 to intermittently deliver a liquid at a fixed flow rate.

In step S201, the control unit 600 performs control to maintain the state where the first drive unit 50 and the second drive unit 60 are stopped so that the tube pump 100 is in the stop state for not delivering the liquid.

In step S202, the control unit 600 controls the selector valve 500 into a closed state so that the selector valve 500 is in the blocking state where the liquid flow is blocked at the second predetermined position P2.

In step S203, the control unit 600 determines whether or not to start a dispensing operation to cause the liquid delivered from the tube pump 100 to the pipe 200 to be intermittently ejected by a fixed amount from the nozzle 201 of the pipe 200 and, if the determination is YES, proceeds with the process to step S204 or, if the determination is NO, ends the process of the present flowchart.

In step S204, the control unit 600 controls the first drive unit 50 and the second drive unit 60 to operate so that the tube pump 100 is in the delivering state for delivering a liquid.

In step S205, the control unit 600 controls the selector valve 500 into an open state so that the selector valve 500 is in the flowing state where a liquid flows through the second predetermined position P2.

In step S204 and step S205, the control unit 600 causes the delivering timing, which is to switch the state of the tube pump 100 from the stop state to the delivering state, and the flowing timing, which is to switch the state of the selector valve 500 from the blocking state to the flowing state, to be the same to synchronize the delivering timing and the flowing timing.

In step S206, the control unit 600 determines whether or not an operation period has elapsed from the delivering timing and, if the determination is YES, proceeds with the process to step S207 or, if the determination is NO, repeats the determination of step S206. The operation period is a time period set in accordance with the amount of a liquid ejected from the other end 200*b* of the pipe 200 by a single time of dispensing operation. For example, the operation period is set to be 0.3 seconds or longer and 30 seconds or shorter.

In step S207, the control unit 600 switches the state of the first drive unit 50 and the second drive unit 60 from the operation state to the stop state so as to switch the state of the tube pump 100 from the delivering state to the stop state.

In step S208, the control unit 600 switches the state of the selector valve 500 from the open state to the closed state so as to switch the state of the selector valve 500 from the flowing state to the blocking state.

In step S207 and step S208, the control unit 600 causes the stop timing, which is to switch the state of the tube pump 100 from the delivering state to the stop state, and the blocking timing, which is to switch the state of the selector valve 500 from the flowing state to the blocking state, to be the same to synchronize the stop timing and the blocking timing.

In step S209, the control unit 600 determines whether or not to end the dispensing operation and, if the determination is YES, ends the process of the present flowchart or, if the determination is NO, proceeds with the process to step S210.

In step S210, the control unit 600 determines whether or not a suspension period has elapsed from the stop timing and, if the determination is YES, proceeds with the process to step S204 or, if the determination is NO, repeats the determination of step S210. The suspension period is a time period set in advance in the control unit 600 by the input from the operator. For example, the suspension period is set to be 1 second or longer and 10 seconds or shorter.

As described above, the control unit 600 synchronizes the delivering timing and the flowing timing to start liquid ejection from the other end 200*b* of the pipe 200 and synchronizes the stop timing and the blocking timing to stop the liquid ejection from the other end 200*b* of the pipe 200. The ejecting amount of the liquid is an amount in accordance with the operation period from the delivering timing to the stop timing. The control unit 600 controls the tube pump 100 and the selector valve 500 so as to repeat the operation to eject a fixed amount of a liquid from the other end 200*b* of the pipe 200 until the dispensing operation ends.

According to the tube pump system 700 of the present embodiment described above, the following effects and advantages are achieved.

According to the tube pump system 700 of the present embodiment, the tube pump 100 intermittently pinches the tube 101 formed of a flexible material, and thereby a liquid in the tube 101 is delivered and guided to the flow channel formed inside the pipe 200 whose one end 200*a* is connected to the tube 101. The orifice 400 providing the smallest sectional area of the channel cross section in the flow channel is arranged at the first predetermined position P1 in the pipe 200. Since the liquid flow resistance at the orifice 400 is largest in the flow channel, a liquid flowing through the flow channel from one end of the pipe 200 to the orifice 400 is in a state where the dynamic pressure is lower and the static pressure is higher compared to a case where the orifice 400 is not provided in the flow channel.

According to the tube pump system 700 of the present embodiment, the tube pump 100 and the selector valve 500 are controlled so that the delivering timing at the tube pump 100 and the flowing timing at the selector valve are synchronized and the stop timing at the tube pump 100 and the blocking timing at the selector valve are synchronized. Since the stop timing at the tube pump 100 and the blocking timing at the selector valve are synchronized, liquid ejection from the other end 200*b* of the pipe 200 is stopped in a state where the static pressure of the liquid is maintained constant between the one end 200*a* of the pipe 200 and the second predetermined position P2 at which the selector valve 500 is arranged.

Further, since the delivering timing at the tube pump 100 and the flowing timing at the selector valve are synchronized, liquid ejection from the other end 200*b* of the pipe 200 is started in a state where the static pressure of the liquid is maintained constant between the one end 200*a* of the pipe 200 and the second predetermined position P2 at which the selector valve 500 is arranged. Since the start and the stop of the liquid ejection from the other end 200*b* of the pipe 200 are switched in a state where the static pressure of the liquid is maintained constant between the one end 200*a* of the pipe 200 and the second predetermined position P2 at which the selector valve 500 is arranged, the liquid delivered from the tube pump 100 to the pipe 200 can be intermittently ejected by a fixed amount from the other end 200*b* of the pipe 200.

According to the tube pump system 700 of the present embodiment, the first roller part 10 and the second roller part 20 are rotated in the same direction about the axis X1 by the first drive unit 50 and the second drive unit 60, respectively, and thereby the first roller part 10 and the second roller part 20 are rotated from the closure position Po1 to the release position Po2 while pinching the tube 101. The control unit 600 controls each of the first drive unit 50 and the second drive unit 60 to allow a liquid flowing in from the inflow side end 101*a* of the tube 101 to be ejected from the outflow side end 101*b* of the tube 101.

The variation range of a liquid pressure determined by the pressure sensor 300 in at least one turn of rotation of the first roller part 10 represents how large the pulsation of the liquid pumped by the tube pump system 700 is. When the tube 101 that has been pinched by one of the first roller part 10 and the second roller part 20 passing through the release position Po2 returns to the original shape, a larger pressure difference between the pressure of a liquid downstream of the release position Po2 and the pressure of a liquid upstream of the release position Po2 results in a larger variation range of the pressure. In the tube pump system 700 of the present embodiment, the control unit 600 controls each of the first drive unit 50 and the second drive unit 60 so that the pressure variation range determined by the pressure sensor 300 is within predetermined values. Thus, even when the state of pulsation dynamically changes, the pulsation can be suitably suppressed in accordance with the change.

According to the tube pump system 700 of the present embodiment, the volume of the flow channel from the first predetermined position P1 to the second predetermined position P2 in the pipe 200 is 1/10 or less of the volume from the one end 200*a* of the pipe 200 to the second predetermined position P2. Thus, when the tube pump 100 is in the stop state and the selector valve 500 is in the blocking state, it is possible to suppress the flow rate of a liquid flowing out from the first predetermined position P1 at which the orifice 400 is arranged to the second position P2 at which the selector valve 500 is arranged. It is thus possible to suitably suppress that the pressure of the liquid in the flow channel from the one end 200*a* of the pipe 200 to the orifice 400 is reduced and the flow rate of the liquid intermittently ejected from the pipe 200 is reduced accordingly.

Second Embodiment

Next, the tube pump system 700 according to a second embodiment of the present disclosure will be described with reference to the drawings. The second embodiment is a modified example for the first embodiment and is substantially the same as the first embodiment except for features described below, and the description of the same features will be omitted below.

The control unit 600 of the first embodiment causes the delivering timing at the tube pump 100 and the flowing timing at the selector valve 500 to be the same and causes the stop timing at the tube pump 100 and the blocking timing at the selector valve 500 to be the same. In contrast, the control unit 600 of the present embodiment defines that the timing after a first predetermined period has elapsed from the delivering timing at the tube pump 100 is the flowing timing at the selector valve 500 and the timing after a second predetermined period has elapsed from the stop timing at the tube pump 100 is the blocking timing of the selector valve 500.

FIG. 8 is a flowchart illustrating a process performed by the control unit 600 to cause the tube pump 100 to intermittently deliver a liquid at a fixed flow rate in the tube pump system 700 according to the second embodiment of the present disclosure. Since steps except for step S304A and step S307A in FIG. 8 are the same as the corresponding steps in FIG. 7 of the first embodiment, the description thereof will be omitted below.

In step S304A, the control unit 600 determines whether or not a first predetermined period has elapsed from the delivering timing and, if the determination is YES, proceeds with the process to step S305 or, if the determination is NO, repeats the determination of step S304A. For example, the first predetermined period is set to 10 msec or longer and 1000 msec or shorter.

In step S307A, the control unit 600 determines whether or not a second predetermined period has elapsed from the stop timing and, if the determination is YES, proceeds with the process to step S308 or, if the determination is NO, repeats the determination of step S307A. For example, the second predetermined period is set to 10 msec or longer and 1000 msec or shorter.

As described above, the control unit 600 defines that the timing after the first predetermined period has elapsed from the delivering timing at the tube pump 100 is the flowing timing at the selector valve 500 and the timing after the second predetermined period has elapsed from the stop timing at the tube pump 100 is the blocking timing at the selector valve 500. According to the tube pump system 700 of the present embodiment, by delaying the flowing timing by the first predetermined period from the delivering timing, it is possible to switch the state of the tube pump 100 from the stop state to the delivering state to increase the pressure of a liquid held in the pipe 200 and then switch the state of the selector valve 500 from the blocking state to the flowing state to increase the ejecting amount of the liquid.

Further, by delaying the blocking timing by the second predetermined period from the stop timing, it is possible to switch the state of the selector valve 500 from the flowing state to the blocking state to reduce the pressure of a liquid in the pipe 200 in the blocking state without switching the state of the tube pump 100 from the delivering state to the stop state to increase the pressure of the liquid held in the pipe 200. Further, by suitably adjusting the first predetermined period and the second predetermined period, it is possible to adjust the ejecting amount of the intermittently ejected liquid to a suitable amount.

Third Embodiment

Next, the tube pump system 700 according to a third embodiment of the present disclosure will be described with reference to the drawings. The third embodiment is a modified example for the first embodiment and is substantially the same as the first embodiment except for features described below, and the description of the same features will be omitted below.

The control unit 600 of the first embodiment causes the delivering timing at the tube pump 100 and the flowing timing at the selector valve 500 to be the same and causes the stop timing at the tube pump 100 and the blocking timing at the selector valve 500 to be the same. In contrast, the control unit 600 of the present embodiment defines that the timing after a third predetermined period has elapsed from the flowing timing at the selector valve 500 is the delivering timing at the tube pump 100 and the timing after a fourth predetermined period has elapsed from the blocking timing at the selector valve 500 is the stop timing at the tube pump 100.

Figure 9:
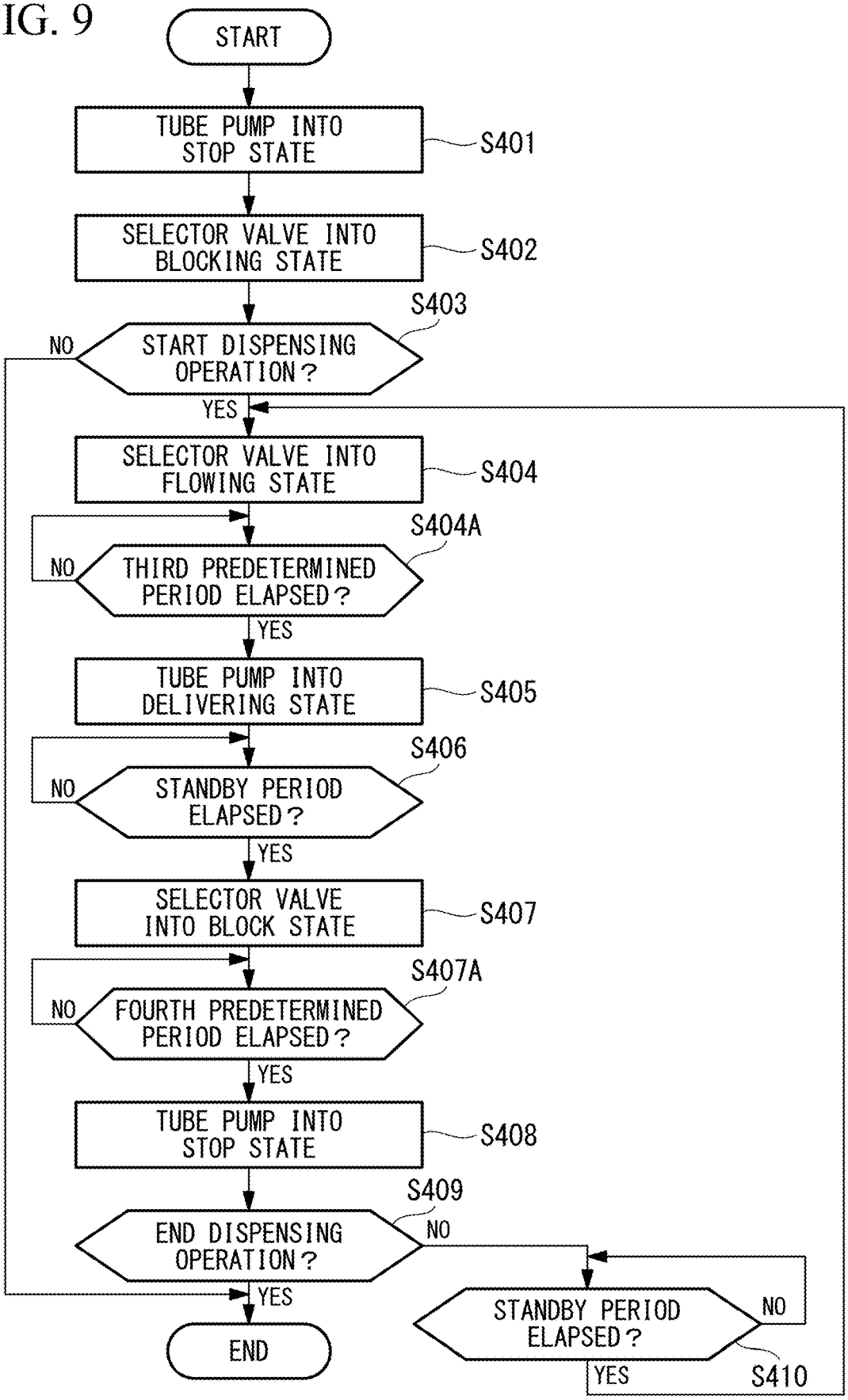
FIG. 9 is a flowchart illustrating a process performed by the control unit to cause the tube pump to intermittently deliver a liquid at a fixed flow rate in a tube pump system according to a third embodiment of the present disclosure.

FIG. 9 is a flowchart illustrating a process performed by the control unit 600 to cause the tube pump 100 to intermittently deliver a liquid at a fixed flow rate in the tube pump system 700 according to the third embodiment of the present disclosure. Since steps except for steps S404, S404A, and S405 and steps S407, S407A, and S408 in FIG. 9 are the same as the corresponding steps in FIG. 7 of the first embodiment, the description thereof will be omitted below.

In step S404, the control unit 600 controls the selector valve 500 into the open state so that the selector valve 500 is in the flowing state where a liquid flows through at the second predetermined position P2.

In step S404A, the control unit 600 determines whether or not a third predetermined period has elapsed from the switching timing and, if the determination is YES, proceeds with the process to step S405 or, if the determination is NO, repeats the determination of step S404A. For example, the third predetermined period is set to 10 msec or longer and 1000 msec or shorter.

In step S405, the control unit 600 controls the first drive unit 50 and the second drive unit 60 to operate so that the tube pump 100 is in the delivering state for delivering a liquid.

In step S407, the control unit 600 switches the state of the selector valve 500 from the open state to the closed state so as to switch the state of the selector valve 500 from the flowing state to the blocking state.

In step S407A, the control unit 600 determines whether or not a fourth predetermined period has elapsed from the blocking timing and, if the determination is YES, proceeds with the process to step S408 or, if the determination is NO, repeats the determination of step S407A. For example, the fourth predetermined period is set to 10 msec or longer and 1000 msec or shorter.

In step S408, the control unit 600 switches the state of the first drive unit 50 and the second drive unit 60 from the operating state to the stop state so as to switch the state of the tube pump 100 from the delivering state to the stop state.

As described above, the control unit 600 defines that the timing after the third predetermined period has elapsed from the flowing timing at the selector valve 500 is the delivering timing at the tube pump 100 and the timing after the fourth predetermined period has elapsed from the blocking timing at the selector valve 500 is the stop timing at the tube pump 100. According to the tube pump system 700 of the present embodiment, by delaying the delivering timing at the tube pump 100 by the third predetermined period from the flowing timing at the selector valve 500, it is possible to switch the state of the selector valve 500 from the blocking state to the flowing state to reduce the pressure of a liquid held in the pipe 200 and then switch the state of the tube pump 100 from the stop state to the delivering state to reduce the ejecting amount of the liquid.

Further, by delaying the stop timing at the tube pump 100 by the fourth predetermined period from the blocking timing at the selector valve 500, it is possible to switch the state of the selector valve 500 from the flowing state to the blocking state to increase the pressure of a liquid held in the pipe 200 and then switch the state of the tube pump 100 from the delivering state to the stop state to increase the pressure of the liquid in the pipe 200 in the blocking state. Further, by suitably adjusting the third predetermined period and the fourth predetermined period, it is possible to adjust the ejecting amount of the intermittently ejected liquid to a suitable amount.

OTHER EMBODIMENTS

Although the tube pump system 700 is provided with the orifice 400 providing the smallest channel sectional area in the channel through which a liquid is guided from the tube pump 100 to the outflow end 702 in the above description, other forms may be employed. For example, a needle valve providing the smallest channel sectional area in the channel through which a liquid is guided from the tube pump 100 to the outflow end 702 may be provided instead of the orifice 400. The channel sectional area of the needle valve can be changed within a predetermined range.

What is claimed is:

1. A tube pump system comprising:

a tube pump configured to deliver a liquid in a tube formed of a flexible material by intermittently pinching the tube and perform switching between a delivering state for delivering a liquid and a stop state for not delivering a liquid;

a pipe connected to the tube at one end of the pipe and including a flow channel formed inside the pipe, the flow channel causing a liquid delivered from the tube to flow in a flow direction from the one end to the other end;

a reduced diameter part arranged at a first predetermined position between the one end and the other end of the pipe and providing the smallest sectional area of a channel cross section orthogonal to the flow direction in the flow channel;

a selector valve arranged at a second predetermined position between the one end and the other end of the pipe and configured to perform switching between a flowing state where a liquid passes through the second predetermined position and a blocking state where a liquid flow is blocked at the second predetermined position; and a control unit configured to control the tube pump and the selector valve so that a liquid is intermittently ejected from the other end of the pipe, wherein the first predetermined position is located between the one end of the pipe and the second predetermined position, wherein the control unit controls the tube pump and the selector valve to synchronize a delivering timing and a flowing timing and synchronize a stop timing and a blocking timing, the delivering timing being a timing to switch the state of the tube pump from the stop state to the delivering state, the flowing timing being a timing to switch the state of the selector valve from the blocking state to the flowing state, the stop timing being a timing to switch the state of the tube pump from the delivering state to the stop state, and the blocking timing being a timing to switch the state of the selector valve from the flowing state to the blocking state.

2. The tube pump system according to claim 1, wherein the tube pump has an accommodation part having an inner circumferential face arc-shaped about an axis, the tube being arranged on the inner circumferential face, a pair of roller parts accommodated in the accommodation part and configured to be rotated about the axis with the tube being closed from a closure position to a release position about the axis, and a pair of drive units configured to rotate each of the pair of roller parts in the same direction about the axis, the tube pump system further comprising a pressure detecting unit to determine a pressure of a liquid delivered from the tube to the pipe, wherein the control unit controls each of the pair of drive units so that a variation range of the pressure of the liquid determined by the pressure detecting unit is within predetermined values when the pair of roller parts are rotated by at least one turn.

3. The tube pump system according to claim 2, wherein the control unit controls a first rotation angle and a second rotation angle so that the variation range of the pressure determined by the pressure detecting unit is within the predetermined value, the first rotation angle being an angle about the axis between the pair of roller parts when a first one of the roller parts passes through the closure position, and the second rotation angle being an angle about the axis between the pair of roller parts when a second one of the roller parts passes through the release position.

4. The tube pump system according to claim 1, wherein the first predetermined position at which the reduced diameter part is arranged is present between the one end of the pipe and the second predetermined position at which the selector valve is arranged, and wherein the volume of the flow channel from the first predetermined position to the second predetermined position in the pipe is 1/10 or less of the volume from the one end of the pipe to the second predetermined position.

5. The tube pump system according to claim 1, wherein the control unit controls the tube pump and the selector valve so that the flowing timing is later than the delivering timing, and the blocking timing is later than the stop timing.

6. The tube pump system according to claim 1, wherein the control unit controls the tube pump and the selector valve so that the delivering timing is later than the flowing timing, and the stop timing is later than the blocking timing.

7. A control method of a tube pump system, wherein the tube pump system comprises a tube pump configured to deliver a liquid in a tube formed of a flexible material by intermittently pinching the tube and perform switching between a delivering state for ejecting a liquid and a stop state for not delivering a liquid, a pipe connected to the tube at one end of the pipe and including a flow channel formed inside the pipe, the flow channel causing a liquid delivered from the tube to flow in a flow direction from the one end to the other end, a reduced diameter part arranged at a first predetermined position between the one end and the other end of the pipe and providing the smallest sectional area of a channel cross section orthogonal to the flow direction in the flow channel, and a selector valve arranged at a second predetermined position between the one end and the other end of the pipe and configured to perform switching between a flowing state where a liquid passes through the second predetermined position and a blocking state where a liquid flow is blocked at the second predetermined position, wherein the first predetermined position is located between the one end of the pipe and the second predetermined position, the control method comprising:

a first control step of controlling the tube pump and the selector valve to synchronize a delivering timing and a flowing timing, the delivering timing being a timing to switch the state of the tube pump from the stop state to the delivering state, and the flowing timing being a timing to switch the state of the selector valve from the blocking state to the flowing state; and a second control step of controlling the tube pump and the selector valve to synchronize a stop timing and a blocking timing, the stop timing being a timing to switch the state of the tube pump from the delivering state to the stop state, and the blocking timing being a timing to switch the state of the selector valve from the flowing state to the blocking state.

* * * * *